US011623274B2

(12) United States Patent
Hangai et al.

(10) Patent No.: US 11,623,274 B2
(45) Date of Patent: Apr. 11, 2023

(54) METAL FOAM PRODUCTION METHOD AND METAL FOAM PRODUCTION APPARATUS

(71) Applicant: JAPAN SCIENCE AND TECHNOLOGY AGENCY, Kawaguchi (JP)

(72) Inventors: Yoshihiko Hangai, Maebashi (JP); Kenji Amagai, Maebashi (JP)

(73) Assignee: JAPAN SCIENCE AND TECHNOLOGY AGENCY, Kawaguchi (JP)

( * ) Notice: Subject to any disclaimer, the term of this patent is extended or adjusted under 35 U.S.C. 154(b) by 213 days.

(21) Appl. No.: 16/627,906

(22) PCT Filed: Jul. 2, 2018

(86) PCT No.: PCT/JP2018/025042
§ 371 (c)(1),
(2) Date: Dec. 31, 2019

(87) PCT Pub. No.: WO2019/013026
PCT Pub. Date: Jan. 17, 2019

(65) Prior Publication Data

US 2021/0146435 A1 May 20, 2021

(30) Foreign Application Priority Data

Jul. 14, 2017 (JP) ..... JP2017-137989

(51) Int. Cl.

| | |
|---|---|
| ***B22F 3/11*** | (2006.01) |
| ***B22F 7/00*** | (2006.01) |
| ***C22C 1/08*** | (2006.01) |

(52) U.S. Cl.
CPC ..... *B22F 3/1125* (2013.01); *B22F 7/006* (2013.01); *C22C 1/08* (2013.01); *B22F 2207/01* (2013.01)

(58) Field of Classification Search
CPC .... B22F 3/1125; B22F 7/006; B22F 2207/01; C22C 1/08
See application file for complete search history.

(56) References Cited

U.S. PATENT DOCUMENTS

2006/0141894 A1 6/2006 Hippke et al.
2007/0158877 A1 7/2007 Rajner et al.
(Continued)

FOREIGN PATENT DOCUMENTS

AT 406558 B 6/2000
CN 102373344 A 3/2012
(Continued)

OTHER PUBLICATIONS

Nov. 27, 2020 Extended European Search Report issued in European Patent Application No. 18831407.4.
(Continued)

*Primary Examiner* — Anthony J Zimmer
*Assistant Examiner* — Dean Mazzola
(74) *Attorney, Agent, or Firm* — Oliff PLC

(57) ABSTRACT

The present invention provides a metal foam production method that enables a foaming process to be performed at low cost and enables controlling of the shape of metal foam. According to the present invention, a mold that transmits light and a precursor prepared by mixing a metal with a foaming agent are used, and a metal foam is produced by irradiating the precursor with a light transmitted through the mold to thereby heat and foam the precursor so as to obtain a metal foam, while controlling the shape of the metal foam by the mold.

13 Claims, 9 Drawing Sheets

(56) References Cited

U.S. PATENT DOCUMENTS

| | | | | |
|---|---|---|---|---|
| 2008/0070998 | A1* | 3/2008 | Takada | G02B 6/0041 521/50.5 |
| 2012/0202089 | A1 | 8/2012 | Hangai et al. | |

FOREIGN PATENT DOCUMENTS

| | | | | |
|---|---|---|---|---|
| EP | 1 036 615 | A1 | 9/2000 | |
| EP | 1036615 | A1 * | 9/2000 | B22F 3/1125 |
| JP | S50-123004 | A | 9/1975 | |
| JP | S51-028507 | A | 3/1976 | |
| JP | S61-193825 | A | 8/1986 | |
| JP | H09-087706 | A | 3/1997 | |
| JP | 2004-225086 | A | 8/2004 | |
| JP | 2006-521467 | A | 9/2006 | |
| JP | 2007-061865 | A | 3/2007 | |
| JP | 2010-116623 | A | 5/2010 | |
| JP | 2013-211293 | A | 10/2013 | |
| WO | 2010-029864 | A1 | 3/2010 | |
| WO | 2010-106883 | A1 | 9/2010 | |
| WO | 2011/046152 | A1 | 4/2011 | |
| WO | WO-2017037522 | A1 * | 3/2017 | B22F 3/1125 |

OTHER PUBLICATIONS

Utsunomiya, Takao et al. "Manufacturing of Porous Aluminum Component by Using Die." The Japan Society of Mechanical Engineers, vol. 77, Series A, pp. 1017-1020, 2011.

Aug. 14, 2018 International Search Report issued in International Patent Application No. PCT/JP2018/025042.

Aug. 14, 2018 Written Opinion of the International Searching Authority issued in International Patent Application No. PCT/JP2018/025042.

* cited by examiner

METAL FOAM PRODUCTION METHOD AND METAL FOAM PRODUCTION APPARATUS

TECHNICAL FIELD

The present invention relates to a metal foam production method and a metal foam production device.

BACKGROUND ART

Metal foam is rich in pores, and therefore is lightweight and has excellent crash energy absorption characteristics and excellent acoustic absorption characteristics. Due to these characteristics, metal foam is attracting much attention as an ultralight multi-functional material in various fields such as automobiles, railways, aerospace, and architecture (see PTL 1 to PTL 3, for example).

Conventionally, a metal foam is produced, for example, by a method in which a precursor is prepared by mixing a raw material metal with a foaming agent, and by heating the precursor with an electric furnace or the like, pores were formed by foaming the precursor with gas generated by the decomposition of the foaming agent.

In the step of foaming the precursor, a mold is used for molding the metal foam (see FIG. 1(*e*) of NPL 1, for example).

CITATION LIST

Patent Literature

PTL 1: Japanese Unexamined Patent Application Publication No. 2007-61865
PTL 2: WO2010/029864
PTL 3: WO2010/106883

Non Patent Literature

NPL 1: Takao UTSUNOMIYA, Atsumi TSUKADA and Yoshihiko HANGAI, "Manufacturing of Porous Aluminum Component by Using Die", Transactions of the Japan Society of Mechanical Engineers, Series A, Vol. 77, pp. 1017-1020, 2011.

SUMMARY OF INVENTION

Technical Problem

In order to put the metal foam into practical use, cost reduction becomes a problem, so that simplification of the production process is required.

In a conventional atmospheric heating wherein an electric furnace or the like is used, since the metal mold is also heated, energy utilization efficiency is not high because the energy used to heat the precursor was reduced by that much.

On the other hand, if the precursor is foamed without using a mold, the shape of the metal foam is not controlled, so that the shape of the metal foam can be any shape. Thus, in order to make the metal foam into a desired shape, it is necessary to perform a processing for making the metal foam into a desired shape after the foaming.

However, since the metal foam is rich in pores, it may be deformed during the processing due to the load applied thereto, and therefore it is difficult to process the metal foam into a desired shape.

If the precursor is heated by irradiating light, since only an area irradiated with the light is heated, energy utilization efficiency will be high, and therefore the precursor can be heated at a lower cost than the atmospheric heating.

However, if a conventional metal mold is used for molding the metal foam, light does not transmit into the metal mold, so that the precursor cannot be irradiated with the light.

If the precursor is foamed without using a mold, as discussed above, it will be necessary to process the metal foam into a desired shape after the foaming. However, since the metal foam contains pores, the metal foam is easy to deform during the processing, so that it is difficult to process the metal foam into a desired shape.

In order to solve the aforesaid problems, it is an object of the present invention to provide a metal foam production method and a metal foam production apparatus capable of performing a foaming process at a low cost and capable of controlling the shape of the metal foam.

Solution to Problem

The present invention (a first metal foam production method) is a metal foam production method which includes the steps of: using a mold that transmits light and a precursor made by mixing a base metal with a foaming agent; and irradiating the precursor with a light transmitted through the mold to thereby heat and foam the precursor to obtain a metal foam, and controlling the shape of the metal foam by the mold.

The mold that transmits light may be a mold made of a transparent material having high transmittance to the light irradiated to the precursor, or a mold made of a material with openings. The material with openings may be, for example, a net-like object, a solid object in which openings are formed, or the like.

If the transparent material or the material with openings used for the mold does not stick to the foamed metal, the mold can be used as it is; while if the transparent material or the material with openings used for the mold sticks to the foamed metal, the mold is preferably used with a release agent.

The release agent is applied to the mold by dispersing, coating, spraying or the like, before the mold is used for producing the metal foam.

Examples of the release agent include general-purpose release agents (such as silicone, graphite, and boron nitride), and mold casting release agents (which include a plurality of types, such as oil-based emulsion, aqueous graphite, water-based heat resistant pigment and the like).

The release agent is selected in consideration of the material for the mold and the raw material metal so that the release agent does not react or interact with the mold and the raw material metal.

The mold may either be produced for each foaming, or be repeatedly used for performing a plurality of times of foaming. However, in order to reduce production costs, it is preferred that the mold be repeatedly used.

Generally, the mold may be used, like a conventional metal mold, as a mold matched to the desired shape of the metal foam, or be used in contact with precursor so that the foaming of the metal foam is regulated; however, the mold may also be used in other fashions.

In the case where the whole periphery of the precursor is surrounded by the mold, the mold may either be the following two types: one is the type in which the entire mold is made of a material that transmits light; the other is the type in which a part of the mold is made of a material that transmits light and the other part is made of a different material.

In the latter case, the precursor is irradiated with a light from the part of the mold made of a material that transmits light.

For example, it is possible to place the precursor on a heat resistant base, wherein the base is used as a lower portion of the mold. In such a case, as long as the precursor can be irradiated with light from the part of the mold other than the base, the base may not be a material that transmits light.

The present invention is a metal foam production method wherein the mold is made of a transparent material.

Examples of the transparent material used for the mold include glass, sapphire, quartz glass, and quartz.

Since the transparent material used for the mold is in contact with the foamed metal, the transparent material needs to have heat resistance so as not to be decomposed or deformed when being brought into contact with the foamed metal. Thus, the range of the transparent material possible to be used varies depending on the melting point of the raw material metal.

Since aluminum, magnesium, zinc, and alloys thereof have relatively low melting points, a wide range of transparent materials such as the glass, sapphire, quartz glass, and quartz described above can be used.

The present invention is a metal foam production method wherein the mold is made of a material with openings.

The present invention is a metal foam production method wherein the material with openings is a net made of metal.

A net made of metal, a reticulated ceramic, a ceramic honeycomb or the like can be used as the mold made of a material with openings. However, it is preferable to use a net made of metal when considering heat resistance, price, or the like.

It is preferred that the net made of metal (hereinafter referred to as "metal mesh") is made of a metal having a melting point higher than that of the raw material metal so that the metal mesh does not deform when being brought into contact with the foamed metal.

In the case where aluminum or an aluminum alloy is used as the raw material metal, the metal mesh may be made of copper, steel or the like.

When a metal mesh is used as the mold, the thickness of the metal wire constituting the metal mesh and the interval between the metal wires (which corresponds to the size of the openings of the metal mesh) need to be selected within an appropriate range.

The thicker the metal wire is (or the smaller the interval between the metal wires is), the lower the light transmits and therefore the lower the energy utilization efficiency is.

Further, in order to control the shape of the metal foam without deforming the metal mesh by the foaming of the metal foam, the metal mesh needs to have a strength of a certain level or higher.

Furthermore, since the metal foam is in soft state during foaming and therefore has surface tension, the metal foam in soft state can be prevented from protruding from between the metal wires if the interval between the metal wires is within a certain range. However, if the interval between the metal wires is too wide, the metal foam in soft state will protrude from between the metal wires. Thus, it is necessary to set the interval between the metal wires within an appropriate range, depending on the allowable protrusion amount and corresponding to the state of the surface tension of the metal during foaming.

Further, when a metal mesh is used as the mold, it is possible to form a complex-shaped mold by deforming the metal mesh, so that it is possible to produce a metal foam having a complex shape.

Further, when a metal mesh is used as the mold, after producing the metal foam, the metal mesh having been used as the mold can be used, as it is, as a composite material for improving the bending strength of the metal foam.

When a reticulated ceramic or a ceramic honeycomb is used as the mold, the width of the solid (ceramic) portion and the size of the openings are selected within an appropriate range.

Further, a material having a certain strength or more is selected for the mold in order to control the shape of the metal foam without being deformed by the foaming of metal foam.

The present invention is a metal foam production method wherein the mold is shaped to surround the precursor, and the metal foam is shaped by the mold.

The present invention is a metal foam production method wherein a plurality of dense metal materials are arranged around the precursor, and the precursor is foamed into a metal foam, so that the dense metal materials are joined by the metal foam.

The dense metal material is a metal material that is dense and contains no pores. Note: such definition for dense metal material is applied throughout full text of this specification.

At this time, the dense metal materials may also be used as a lateral mold when forming the metal foam from the precursor. Since the dense metal materials do not transmit light, a mold made of a material that transmits light is arranged with respect to the precursor.

In such a case, the irradiation range of the light is selected so that only the precursor and its surrounding area are locally irradiated with light so as to be heated, and thereby it is possible to reduce the effects of heat on the surrounding dense metal materials, so that the dense metal materials can be joined without being damaged.

The present invention is a metal foam production method wherein a plurality of other metal foams are arranged around the precursor, and the precursor is foamed into a metal foam, so that the other metal foams are joined by the metal foam.

At this time, the other metal foams may also be used as a lateral mold when forming the metal foam from the precursor. Since the other metal foams do not transmit light, a mold made of a material that transmits light is arranged with respect to the precursor.

In such a case, the irradiation range of the light is selected so that only the precursor and its surrounding area are locally irradiated with light so as to be heated, and thereby it is possible to reduce the effects of heat on the surrounding other metal foams, so that the other metal foams can be joined without being damaged.

The present invention is a metal foam production method wherein the precursor and a dense metal material are used, and the precursor is foamed into a metal foam, so that the dense metal material is joined to the metal foam.

At this time, the dense metal material may also be used as a part of a mold when forming the metal foam from the precursor. Since the dense metal material does not transmit light, a mold made of a material that transmits light is arranged with respect to the precursor.

In such a case, the irradiation range of the light is selected so that only the precursor and its surrounding area are locally irradiated with light so as to be heated, and thereby it is possible to reduce the effects of heat on the dense metal material, so that the dense metal material can be joined without being damaged.

The present invention is a metal foam production method wherein using a precursor, a dense metal material, and another metal foam, the dense metal material and the other metal foam are joined by the metal foam formed by foaming from the precursor.

At this time, the dense metal material and the other metal foam may also be used as a lateral mold when forming the metal foam from the precursor. Since the dense metal material and the other metal foam do not transmit light, a mold made of a material that transmits light is arranged with respect to the precursor.

In such a case, the irradiation range of the light is selected so that only the precursor and its surrounding area are locally irradiated with light so as to be heated, and thereby it is possible to reduce the effects of heat on the dense metal material and the other metal foam, so that the dense metal material and the other metal foam can be joined without being damaged.

In the present invention, since the precursor is heated by irradiating the precursor with a light, it is possible to select the irradiation range of the light so that the area other than the irradiation range of the light is not heated. Thus, heating efficiency can be improved, and the effects of heat on the area other than the irradiation range of the light can be reduced.

The irradiation range of the light may be set by, for example, setting the focus of the light source, providing a mask having an opening to partially shield the light, or employing a mold having two portions: one is a portion that transmits light, and the other is a portion that does not transmit light.

Further, the irradiation range of the light may also be changed by changing the relative positional relationship between the light source, the mold, and the precursor. For example, the irradiation range of the light may be changed by scanning the light source with respect to the mold and precursor, or by moving the mold and precursor with respect to the fixed light source.

The present invention is a metal foam production method wherein an irradiation range of light is selected by setting focus of a light source.

The present invention is a metal foam production method wherein an irradiation range of light is selected by providing a mask having an opening to shield light.

The present invention is a metal foam production method wherein the mold is a cylindrical mold.

By using a cylindrical mold (made of a transparent material or a metal mesh), it is also possible to irradiate the precursor with light from back side or lower side to thereby heat the precursor. Further, by using a cylindrical mold, it is also possible to irradiates the entire circumference of the mold with a light emitted from a light source arranged around the mold, or to irradiate the mold with a light emitted from a fixed light source while rotating the mold around its central axis, so that the entire circumference of the mold is sequentially irradiated with light.

The present invention is a metal foam production method wherein a plurality of the precursors respectively made using a plurality of types of metals having different melting points are arranged so that respective metal foams thereof are joined to each other after foaming, and each precursor is irradiated with a light so as to be heated to thereby produce a functionally graded material whose properties spatially vary. Examples of the properties which spatially vary include mechanical characteristics (particularly, crash energy absorption characteristics), noise absorption characteristics, and the like.

At this time, for example, the intensity of a plurality of lights respectively emitted from a plurality of light sources is changed for each light source, and the plurality of the precursors are respectively irradiated with the plurality of lights, so that each precursor is foamed.

The present invention is a metal foam production method wherein a plurality of metals each having different melting points are joined, and each metal of precursors in which a foaming agent is mixed with the plurality of metals is irradiated with a light so as to be heated, so that a functionally graded material whose properties spatially vary is produced. Examples of the properties which spatially vary include mechanical characteristics (particularly, crash energy absorption characteristics), noise absorption characteristics, and the like.

At this time, for example, the intensity of a plurality of lights respectively emitted from a plurality of light sources is changed for each light source, and each metal of the precursors is irradiated with a light, so that each of the plurality of metals is foamed.

Incidentally, when producing a functionally gradient material in which metal foams of different materials are joined, the conditions of the light-to-be-irradiated (output, wavelength range or the like) are changed according to the difference in the melting point of each precursor metal, and the irradiation range of light is set so that the effects of heat on the other precursor(s) and/or metal foam(s) already produced are suppressed.

Further, instead of changing the conditions of the light-to-be-irradiated according to the difference in the melting point of metal of each precursor, it is also possible to select the mold so that the transmittance of the mold varies depending on its different portion corresponding to each precursor (in the case where a mold made of transparent material is used), or select the aperture ratio of the mold varies depending on its different portion corresponding to each precursor (in the case where a mold made of a material with openings is used). Thus, by selecting the transmittance of the mold or the aperture ratio of the mold, it is possible to reduce the intensity of light irradiated to the precursor corresponding to the metal having lower melting point, even if light sources having the same intensity are used.

By reducing the intensity of light irradiated to the precursor corresponding to the metal having lower melting point, the temperature-rising speed of such precursor will become slow, so that it is possible to reduce the difference in foaming time between the precursor corresponding to the metal having lower melting point and the precursor corresponding to the metal having higher melting point. Further, by selecting the conditions of the light to be irradiated, the transmittance of the mold, or the aperture ratio of the mold according to the melting point of metal of each precursor, the time required for foaming each precursor is controlled to be almost the same, so that each precursor can be uniformly foamed.

The present invention is a metal foam production method wherein the mold is made of a material with openings, and the aperture ratio of each part of the mold corresponding to each precursor is selected so that the part corresponding to the precursor made from a metal having a lower melting point has smaller aperture ratio.

Since the part of the mold corresponding to the precursor made from a metal having a lower melting point has smaller aperture ratio, the intensity of light irradiated to such precursor is reduced, and therefore the temperature-rising speed can be slowed down.

The present invention (a second metal foam production method of the present invention) is a metal foam production method which includes the steps of: using a precursor made by mixing a metal with a foaming agent, a sealed container at least partly made of a transparent material that transmits light, and a light source arranged outside the sealed container; and containing the precursor in the sealed container, and irradiating the precursor with a light emitted from the light source and transmitted through the transparent material to thereby heat and foam the precursor to produce a metal foam.

The sealed container is at least partly made of a transparent material.

The transparent materials listed as the material for the sealed container, such as glass, sapphire, quartz glass, crystal or the like, can be used as the transparent material of the sealed container.

Incidentally, when all or most of the sealed container is made of transparent material, it is preferable to use a transparent material having pressure resistance and strength.

The configuration adopted by a conventional sealed container can be applied to the part of the sealed container that is not made of transparent material. For example, the sealed container may be made of metal or the like.

The present invention is a metal foam production method, wherein a mold that transmits light is arranged inside the sealed container, and the shape of the metal foam is controlled by the mold by irradiating the precursor with a light emitted from the light source, transmitted through the transparent material, and transmitted through the mold.

The present invention is a metal foam production method, wherein the precursor is heated in a condition in which the sealed container is evacuated.

The present invention is a metal foam production method, wherein the precursor is heated in a condition in which the inside of the sealed container is set to a predetermined atmosphere.

The present invention (a third metal foam production method of the present invention) is a metal foam production method which includes the steps of: using a precursor made by mixing a metal with a foaming agent, and a mold that transmits light; irradiating the precursor with a light so that the precursor is heated and caused to foam; during foaming, pressing the precursor with the mold so that the precursor is provided with a shape; and irradiating the precursor with a light transmitted through the mold to produce a metal foam, while controlling the shape of the metal foam by the mold.

The present invention (a metal foam production apparatus of the present invention) is an apparatus for producing a metal foam. The apparatus includes a sealed container at least partly made of a transparent material that transmits light, and a light source arranged outside the sealed container. In such an apparatus, a metal foam is produced by containing a precursor made by mixing a metal with a foaming agent in the sealed container and irradiating the precursor with a light emitted from the light source and transmitted through the transparent material, so that the precursor is heated and foamed.

In other words, the metal foam production apparatus of the present invention is an apparatus for realizing the second metal foam production method of the present invention In the present invention, a single metal element material or an alloy can be used as the metal that is a raw material of the metal foam.

Examples of such metal or alloy include aluminum, aluminum alloys, magnesium alloys, zinc, zinc alloys, copper, copper alloys, iron, iron alloys, and the like.

Various foaming agents, such as those conventionally used for foaming metal foams, or those proposed for foaming metal foams, can be used as the foaming agent of the present invention. Examples of such foaming agent include $TiH_2$ (titanium hydride), zirconium hydride and the like.

However, it is preferable to select a foaming agent whose foaming temperature falls into an appropriate range so as to match the melting point of the raw material metal.

In the present invention, the method for producing the precursor is not particularly limited as long as the precursor is made by mixing a metal with a foaming agent.

For example, the precursor can be produced by using various methods, such as a method in which metal powder is mixed with foaming agent powder and the mixture is solidified and shaped, a method in which foaming agent powder is mixed into a metal plate with a friction-stirring tool as described in PTL 2 and PTL 3.

In the present invention, for example, a halogen lamp, an infrared lamp or the like can be used as the light source for irradiating the precursor.

Further, conditions such as the output of the light source, the wavelength range of the light of the light source, the irradiation time and the like are selected so that the precursor can be provided with sufficient energy necessary to produce the metal foam when being heated, and so that light reflection and light absorption caused by a light transmissive material can be minimized.

Advantageous Effects of Invention

According to the present invention (the first metal foam production method), the precursor is heated by irradiating the precursor with a light transmitted through the mold, so that heat loss caused by the mold is reduced, and therefore the precursor can be heated with high energy utilization efficiency. Thus, heating can be performed at lower cost than an atmospheric heating method, and therefore the metal foam can be produced at lower cost.

Further, since the shape of the metal foam is controlled by the mold, it is possible to produce a metal foam having a desired shape.

Further, since heating is performed by irradiating light, it is possible to perform heating with an apparatus having a relatively simple configuration.

According to the present invention, particularly, since a net made of metal (metal mesh) is used as the mold, it is possible to configure a mold at lower cost; further, since it is easy to provide the mold with a shape in the case where the mold is made of a metal mesh, it is possible to produce a metal foam having an arbitrary shape simply and at low cost, and therefore production cost of the metal foam can be further reduced.

According to the present invention (the second metal foam production method), the precursor is heated by irradiating the precursor with a light, so that heat loss is reduced, and therefore the precursor can be heated with high energy utilization efficiency. Thus, heating can be performed at lower cost than an atmospheric heating method, and therefore the metal foam can be produced at lower cost.

Further, the inside of the sealed container can be evacuated into vacuum or set to a desired atmosphere, and the atmosphere can be prevented from affecting the light source. Further, compared with a configuration in which a heat source or a light source are provided in a hermetic container, the configuration of the light source can be simplified, so that the cost of the production apparatus can be reduced.

According to the present invention, particularly, by evacuating the inside of the sealed container into vacuum, the surface of the metal foam can be prevented from being oxidized.

Further, according to the present invention, when the inside of the sealed container is evacuated into vacuum, since the precursor is largely foamed, it is possible to: form a metal foam having large pores, or produce a large metal foam from a small precursor, or form a metal foam with less foaming agent.

According to the present invention (the third metal foam production method), the precursor is heated by irradiating the precursor with a light, so that heat loss is reduced, and therefore the precursor can be heated with high energy utilization efficiency. Thus, heating can be performed at lower cost than an atmospheric heating method, and therefore the metal foam can be produced at lower cost.

Further, the precursor is pressed with the mold so that the precursor is provided with a shape, and thereafter the shape of the metal foam is controlled by the mold, so that it is possible to produce a metal foam having a desired shape.

Further, by combining any one of the first to third metal foam production methods of the present invention with a method for producing a precursor using a friction-stirring tool, production process and production facilities can be simplified as compared with a conventional metal foam production method.

According to the present invention (the metal foam production apparatus of the present invention), the precursor is heated by irradiating the precursor with a light, so that heat loss is reduced, and therefore the precursor can be heated with high energy utilization efficiency. Thus, heating can be performed at lower cost than an atmospheric heating method, and therefore the metal foam can be produced at lower cost.

Further, the inside of the sealed container can be evacuated into vacuum or set to a predetermined atmosphere, and the atmosphere can be prevented from affecting the light source. Further, compared with a configuration in which a heat source or a light source are provided in a hermetic container, the configuration of the light source can be simplified, so that the cost of the production apparatus can be reduced.

DESCRIPTION OF EMBODIMENTS

Concrete embodiments of the present invention will be described below with reference to attached drawings.

Note, it is to be understood that the present invention is not limited to the embodiments described above, and any configurations within the scope defined by the claims can be adopted.

First Embodiment

Figure 1A:
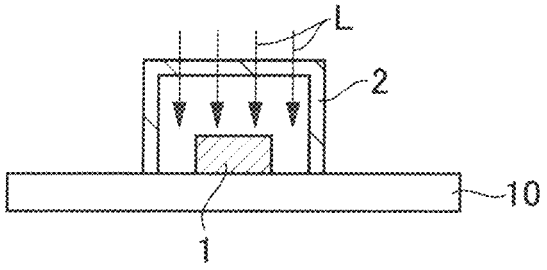
FIGS. 1A and 1B are schematic cross-sectional views showing a first embodiment of the present invention.
Figure 1B:
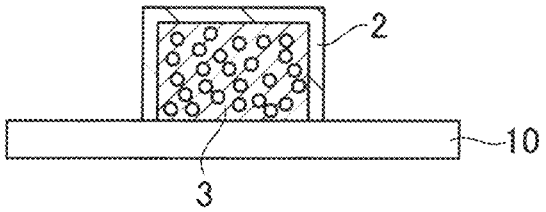

A first embodiment of the present invention is shown in schematic cross-sectional views of FIGS. 1A and 1B.

In the present embodiment, a precursor is surrounded by a mold made of a transparent material, and a metal foam is shaped by the mold.

As shown in FIG. 1A, a precursor 1 made by mixing a metal with a foaming agent is placed on a base (table) 10, and a transparent material 2 is arranged on the base 10 to surround the precursor 1. The transparent material 2 constitutes a mold that molds a metal foam. The base 10 is made of a material having heat-resisting properties, and this definition for base 10 is applied to all embodiments and modifications described below.

Further, the precursor 1 is heated and foamed by being irradiated with a light L transmitted through the transparent material 2 from above.

With such an arrangement, as shown in FIG. 1B, the metal foam 3 which is molded into the shape of the transparent material 2 is formed by filling the inside of the transparent material 2.

In this manner, it is possible to produce the metal foam 3 molded into the shape of the mold made of the transparent material 2.

In the present embodiment, the materials mentioned above can be respectively used for the metal and foaming agent of the precursor 1, and the transparent material 2.

Second Embodiment

Figure 2A:
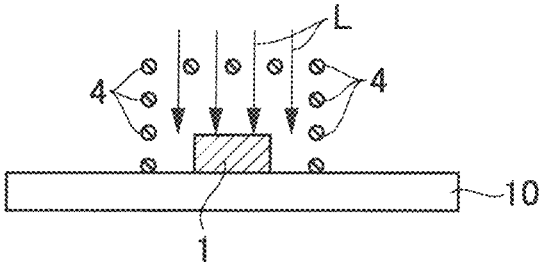
FIGS. 2A and 2B are schematic cross-sectional views showing a second embodiment of the present invention.
Figure 2B:
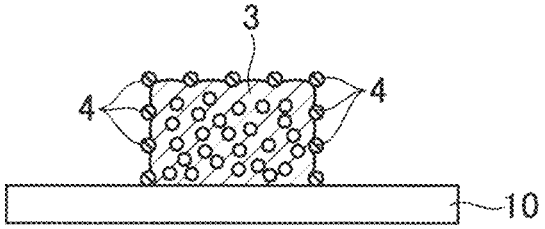

A second embodiment of the present invention is shown in schematic cross-sectional views of FIGS. 2A and 2B.

In the present embodiment, the precursor is surrounded by a mold made of a metal mesh, and a metal foam is shaped by the mold.

As shown in FIG. 2A, the precursor 1 made by mixing a metal with a foaming agent is placed on a base 10, and a metal mesh 4 is arranged on the base 10 to surround the precursor 1. The metal mesh 4 constitutes a mold that molds a metal foam.

Further, the precursor 1 is heated and foamed by being irradiated with a light L passing through the opening portions of the metal mesh 4 from above.

With such an arrangement, as shown in FIG. 2B, a metal foam 3 is formed by filling the inside of the metal mesh 4 and molded into the shape of the metal mesh 4.

In this manner, it is possible to produce the metal foam 3 molded into the shape of the mold made of the metal mesh 4.

In the present embodiment, the materials mentioned above can be respectively used for the metal and foaming agent of the precursor 1, and the metal mesh 4.

The thickness of the metal wires of the metal mesh 4 is selected so that the strength of the metal mesh 4 is ensured and the light L is sufficiently transmitted through the metal mesh 4. Further, the width of the opening portions of the metal mesh 4 and the interval between the metal wires are selected so that the metal foam 3 does not protrude from the metal mesh 4.

Third Embodiment

Figure 3A:
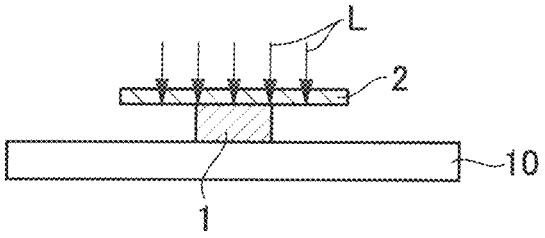
FIGS. 3A and 3B are schematic cross-sectional views showing a third embodiment of the present invention.
Figure 3B:
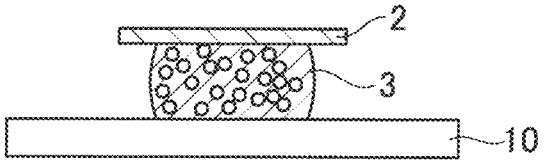

A third embodiment of the present invention is shown in schematic cross-sectional views of FIGS. 3A and 3B.

In the present embodiment, a mold made of a transparent material is placed on a precursor, and the shape of a metal foam is controlled by the mold.

As shown in FIG. 3A, a precursor 1 made by mixing a metal with a foaming agent is placed on a base 10, and a plate-like transparent material 2 is placed on the precursor 1. The transparent material 2 constitutes a mold that controls the shape of the metal foam.

Further, the precursor 1 is heated and foamed by being irradiated with a light L transmitted through the transparent material 2 from above.

With such an arrangement, as shown in FIG. 3B, a metal foam 3 whose upper surface is controlled to be flat by the transparent material 2 is formed.

In this manner, it is possible to produce the metal foam 3 whose shape is controlled by the mold made of the transparent material 2.

In the present embodiment, since no mold is provided in the horizontal direction of the precursor 1, the precursor 1 is freely foamed in the horizontal direction, so that the metal foam 3 spreads in the horizontal direction; however, since a mold is provided on the upper face of the precursor 1, the upper face of the metal foam 3 is controlled to be flat.

In the present embodiment, the materials mentioned above can be respectively used for the metal and foaming agent of the precursor 1, and the transparent material 2.

(Modification)

With respect to the third embodiment, the transparent material 2 may be replaced with a plate-like metal mesh.

In such a case, similarly to the second embodiment, the metal foam whose upper surface is controlled to be approximately flat by the plate-like metal mesh is formed by irradiating the precursor 1 with a light passing through the opening portions of the metal mesh.

In FIG. 3A, the mold 2 is placed directly on the precursor 1. Alternatively, it is also possible to shape the metal foam by freely foaming the precursor first, and then, during foaming, perform press working with a mold that transmits light. With such a method, it is possible to produce a metal foam having a complicated shape by performing press working. Further, since press working is performed during foaming, the press working can be performed with a low load.

Fourth Embodiment

Figure 4A:
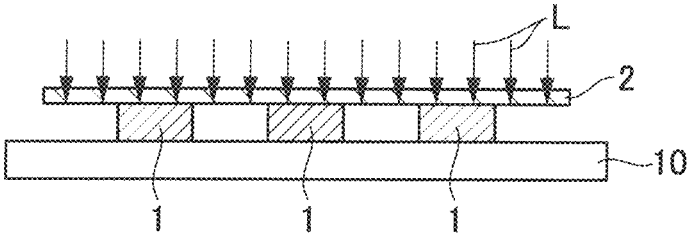
FIGS. 4A and 4B are schematic cross-sectional views showing a fourth embodiment of the present invention.
Figure 4B:
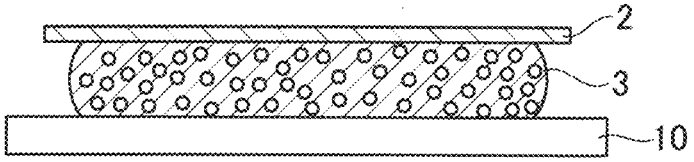

A fourth embodiment of the present invention is shown in schematic cross-sectional views of FIGS. 4A and 4B.

The present embodiment is configured by applying the third embodiment. To be specific, in the present embodiment, a mold made of a transparent material is placed on a plurality of precursors, and the shape of metal foam is controlled by the mold so as to produce one metal foam in which the plurality of precursors are joined into one.

As shown in FIG. 4A, three precursors 1 are arranged on the base 10 at a predetermined interval, and one plate-like transparent material 2 is placed on the three precursors 1. The plate-like transparent material 2 constitutes a mold that controls the shape of the metal foam.

Further, the precursors 1 are each heated and foamed by being irradiated with a light L transmitted through the transparent material 2 from above.

With such an arrangement, as shown in FIG. 4B, each precursor 1 is foamed to form a metal foam, and the metal foam such formed is joined and integrated with the adjacent metal foam. Further, the integrated metal foam is controlled by the transparent material 2 so that the upper surface thereof becomes flat.

In this manner, it is possible to produce a larger metal foam 3 from three precursors 1.

The interval between the precursors 1 adjacent to each other is selected in consideration of the degree of foaming so that the precursors 1 are joined to each other after foaming.

In FIG. 4A, three precursors 1 are used; however, the number of precursors 1 is not limited.

The arrangement of the plurality of precursors is not particularly limited. For example, the plurality of precursors can be arranged longitudinally and laterally, concentrically, or the like.

The same integrated metal foam can also be produced even if the plurality of precursors are arranged adjacent to each other (with no interval).

However, if the distance between the precursors is increased, foaming can be performed freely until the precursors join together, so that foaming can be performed quickly, and the outer peripheral portion and the inside of the metal foam can be more uniformly foamed.

(Modification)

With respect to the fourth embodiment, the transparent material 2 may be replaced with a plate-like metal mesh.

In such a case, similarly to the second embodiment, the metal foam whose upper surface is controlled to be approximately flat by the plate-like metal mesh is formed by irradiating the plurality of precursors 1 with a light passing through the opening portions of the metal mesh.

In FIG. 4A, the mold 2 is placed directly on each precursor 1. Alternatively, it is also possible to shape the metal foam by freely foaming the precursor first, and then, during foaming, perform press working with a mold that transmits light. With such a method, it is possible to produce a metal foam having a complicated shape by performing press working to obtain an integrated metal foam. Further, since press working is performed during foaming, the press working can be performed with lower load.

Fifth Embodiment

Figure 5A:
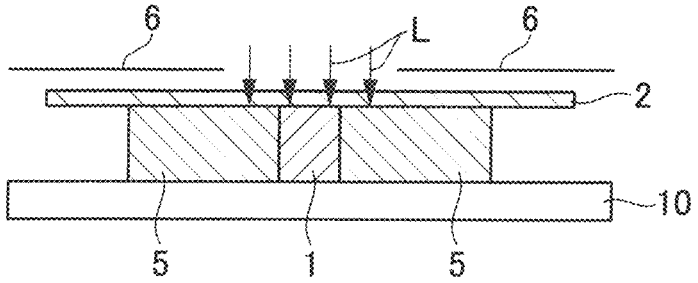
FIGS. 5A and 5B are schematic cross-sectional views showing a fifth embodiment of the present invention.
Figure 5B:
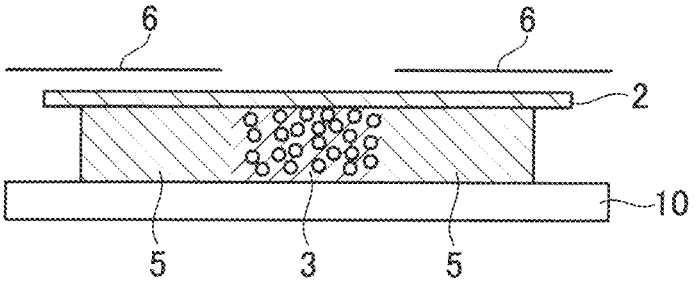

A fifth embodiment of the present invention is shown in schematic cross-sectional views of FIGS. 5A and 5B.

In the present embodiment, a metal foam is formed between two dense metal materials by applying the aforesaid third embodiment.

As shown in FIG. 5A, a precursor 1 and two dense metal materials 5 are arranged on the base 10 so that the precursor 1 is sandwiched between the two dense metal materials 5, and one plate-like transparent material 2 is placed on the dense metal materials 5 and precursor 1. The plate-like transparent material 2 constitutes a mold that controls the shape of the metal foam. Incidentally, the dense metal material 5 can be moved relative to the base 10 and the transparent material 2, instead of being fixed to the base 10 and the transparent material 2.

Further, a mask 6 that shields light and that has an opening is provided above the transparent material 2. Irradiation range of the light L is regulated by the mask 6.

Further, the precursor 1 is heated and foamed by being irradiated with the light L passing through the opening of the mask 6 and transmitted through the transparent material 2 from above.

With such an arrangement, as shown in FIG. 5B, the precursor 1 is foamed to form a metal foam 3, and the metal foam 3 is joined to the adjacent dense metal materials 5. Further, the metal foam 3 is controlled by the transparent material 2 so that the upper surface thereof becomes flat. The dense metal materials 5 are moved outward by the foamed metal foam 3.

In this manner, it is possible to form the metal foam 3 between the dense metal materials 5, so that the dense metal materials 5 and the metal foam 3 are joined to each other. Further, the dense metal materials 5 also function as lateral molds when the metal foam 3 is being formed from the precursor 1.

The dense metal materials 5 may also be a metal (metal element or alloy) having a higher melting point than the metal constituting the precursor 1 and the metal foam 3.

In FIGS. 5A and 5B, the size of the opening of the mask 6 is set in consideration of the size when the precursor 1 is foamed to become the metal foam 3, so that the size of the opening of the mask 6 is slightly larger than the size of the finally formed metal foam 3. Therefore, heating can be performed until foaming is completed. Further, since the dense metal materials 5 are irradiated with light only in the vicinity of the junction with the precursor 1, heat applied to the dense metal materials 5 can be suppressed. Further, the irradiation range of the light is selected by the mask 6 so that only the precursor 1 and its periphery are locally irradiated with light so as to be heated, and thereby effects of heat on the dense metal materials 5 can be suppressed. Therefore, the dense metal materials 5 can be joined without being damaged.

Incidentally, the size of the opening of the mask 6 may also be set different ways. For example, the size of the opening of the mask 6 may also be set to be equal to the size of the metal foam 3 to be finally formed, or to be equal to the initial size of the precursor 1. The size of the opening of the mask 6 is suitably set in consideration of the foaming of the metal foam 3 and the effects of the heat applied to the dense metal materials 5.

In the present embodiment, the mask 6 is provided above the transparent material 2. However, the irradiation range of the light L may also be regulated by other configurations, such as a configuration in which the mask 6 is placed on and in contact with the transparent material 2, a configuration in which a reflection film or an absorption film is formed on the upper surface of the transparent material 2 to shield the light L, a configuration in which the irradiation range of the light L is regulated from the light source side by, for example, setting the focus of the light source, or the like.

Incidentally, the irradiation range of the light L may also be regulated by a configuration in which the mold is configured by two portions: one is a portion made of the transparent material 2, and the other is a portion made of a material that does not transmits light. However, in the case where the mold is configured by two portions, it is likely that the joint between the two portions tends to be weak, and the cost of the mold increases. Therefore, it is preferred that the irradiation range of the light is regulated by a configuration different from the mold.

It is possible to irradiate the precursor 1 with a light to thereby heat the precursor 1 to produce the metal foam 3, and join the dense metal materials 5 and the metal foam 3, even in a state where the dense metal materials 5 and the precursor 1 are arranged apart from each other. However, in such a case, if the distance between the dense metal materials 5 and the precursor 1 is not set within an appropriate range, the foamed metal foam 3 and the dense metal materials 5 will not be brought into close contact with each other at the interface, and therefore there is a possibility that sufficient joining strength may not be obtained.

(Modification 1)

With respect to the fifth embodiment, the transparent material 2 may be replaced with a plate-like metal mesh.

In such a case, as a configuration for regulating the irradiation range of the light (such as setting focus of a light source, providing a mask above the metal mesh, or the like), the precursor 1 is irradiated with a light passing through the opening portions of the metal mesh.

With such an arrangement, a metal foam whose upper surface is controlled by the plate-like metal mesh so as to become substantially flat is formed, and the dense metal materials and the metal foam are joined to each other.

(Modification 2)

With respect to the fifth embodiment, the present invention also includes a configuration in which a precursor and a dense metal material are used, and the dense metal material is arranged only on one side of the precursor, so that a metal foam obtained by foaming the precursor is joined with the dense metal material.

In such a case, as a configuration for regulating the irradiation range of the light (such as setting focus of a light source, providing a mask above the plate-like mold, or the like), the precursor 1 is irradiated with a light passing through the mold.

Thus, a metal foam whose upper surface is controlled by the plate-like mold so as to become substantially flat is formed, and the dense metal material and the metal foam are joined to each other. Further, the irradiation range of the light is selected by a mask or the like so that only the precursor and its surrounding area are irradiated with light locally so as to be heated, and thereby it is possible to reduce the effects of heat on the dense metal material, so that the dense metal material can be joined without being damaged.

Sixth Embodiment

Figure 6A:
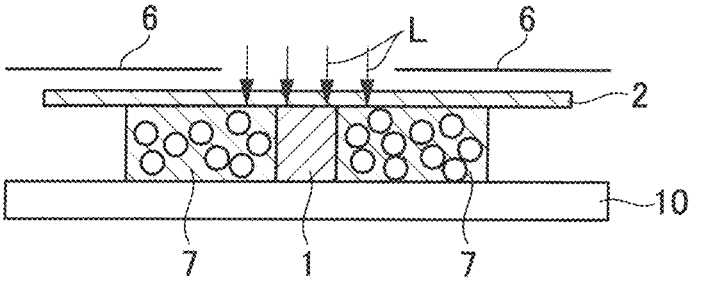
FIGS. 6A and 6B are schematic cross-sectional views showing a sixth embodiment of the present invention.
Figure 6B:
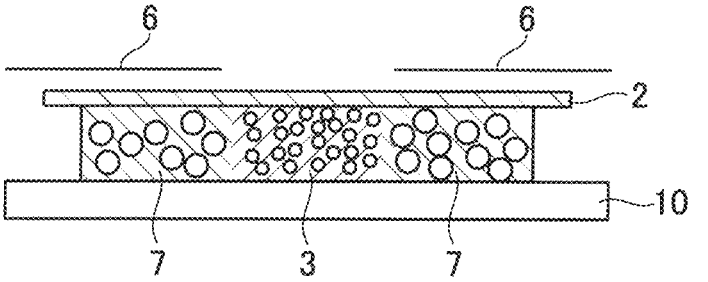

A sixth embodiment of the present invention is shown in schematic cross-sectional views of FIGS. 6A and 6B.

The present embodiment is a configuration in which a metal foam is formed between two other metal foams by applying the third embodiment and the fifth embodiment described above.

As shown in FIG. 6A, a precursor 1 and two other metal foams 7 are arranged on the base 10 so that the precursor 1 is sandwiched between the two other metal foams 7, and one plate-like transparent material 2 is placed on the other metal foams 7 and precursor 1. The plate-like transparent material 2 constitutes a mold that controls the shape of the metal foam. Incidentally, the other metal foams 7 can be moved relative to the base 10 and the transparent material 2, instead of being fixed to the base 10 and the transparent material 2.

Further, a mask 6 that shields light and that has an opening is provided above the transparent material 2. Irradiation range of the light L is regulated by the mask 6.

Further, the precursor 1 is heated and foamed by being irradiated with a light L passing through the opening of the mask 6 and transmitted through the transparent material 2 from above.

With such an arrangement, as shown in FIG. 6B, the precursor 1 is foamed to form a metal foam 3, and the metal foam 3 is joined to the adjacent other metal foams 7. Further, the shape of the upper surface of the metal foam 3 is controlled to be flat by the transparent material 2. The other metal foams 7 are moved outward by the foamed metal foam 3.

In this manner, it is possible to form the metal foam 3 between the other metal foams 7, so that the other metal foams 7 and the metal foam 3 are joined to each other. Further, the other metal foams 7 also function as a lateral mold when the metal foam 3 is being formed from the precursor 1.

As shown in FIGS. 6A and 6B, the irradiation range of the light is selected by the mask 6 so that only the precursor 1 and its periphery are locally irradiated with light so as to be heated, and thereby effects of heat on the other metal foams 7 can be suppressed. Therefore, the other metal foams 7 ca be joined without being damaged.

The other metal foams 7 may also be a metal (metal element or alloy) having a higher melting point than the metal constituting the precursor 1 and the metal foam 3.

(Modification 1)

With respect to the sixth embodiment, the transparent material 2 may be replaced with a plate-like metal mesh.

In such a case, as a configuration for regulating the irradiation range of the light (such as setting focus of a light source, providing a mask above the metal mesh, or the like), the precursor 1 is irradiated with a light passing through the opening portions of the metal mesh.

With such an arrangement, a metal foam whose upper surface is controlled by the plate-like metal mesh so as to become substantially flat is formed, and the other metal foams and the metal foam are joined to each other.

(Modification 2)

With respect to the sixth embodiment, it is possible to, by combining the configuration of the fifth embodiment with the sixth embodiment described above, use a precursor, a dense metal material and other metal foam and foam the precursor into a metal foam, so that the dense metal material and the other metal foam are joined by the metal foam. In such a case, the precursor is arranged between the dense metal material and the other metal foam, and a plate-like mold is placed above the precursor, the dense metal material and the other metal foam. The precursor is irradiated with a light transmitted through the mold so as to be heated and foamed.

With such an arrangement, the precursor is foamed to form a metal foam, and the metal foam is joined to the adjacent dense metal materials and the adjacent other metal foam respectively. Further, the metal foam is controlled by the mold so that the upper surface thereof becomes flat.

In this manner, it is possible to form a metal foam between a dense metal material and other metal foam, so that the dense metal material and the other metal foam are joined to each other by the metal foam.

At this time, the irradiation range of the light is selected by a mask or the like so that only the precursor and its periphery are locally irradiated with light so as to be heated, and thereby the effects of heat on the dense metal material and the other metal foam can be suppressed. Therefore, the dense metal material and the other metal foam can be joined without being damaged.

Seventh Embodiment

Figure 7A:
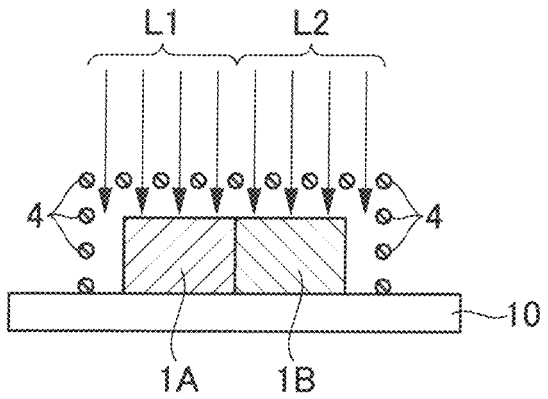
FIGS. 7A and 7B are schematic cross-sectional views showing a seventh embodiment of the present invention.
Figure 7B:
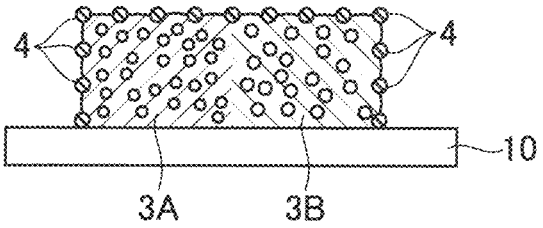

A seventh embodiment of the present invention is shown in schematic cross-sectional views of FIGS. 7A and 7B.

In the present embodiment, two metal foams obtained from different metal are joined to form a metal foam joined body.

As shown in FIG. 7A, On the base 10, two precursors 1A and 1B made of different metals are arranged on the base 10 so that the two precursors 1A and 1B are in contact with each other. Further, a metal mesh 4 is provided so as to surround the precursors 1A and 1B from above and lateral. The metal mesh 4 constitutes a mold that controls the shape of the metal foam.

Further, the precursors 1A and 1B is heated and foamed by being irradiated respectively with a light L1 and a light L2 passing through the opening portions of the metal mesh 4 from above.

With such an arrangement, as shown in FIG. 7B, the precursors 1A and 1B are foamed to form two metal foams 3A and 3B each constituted by different metals, and the two metal foams 3A and 3B are joined to each other. Further, the shapes of the metal foams 3A and 3B are controlled by the metal mesh 4.

In this manner, it is possible to form a metal foam joined body in which the metal foams 3A and 3B constituted by different metals are joined to each other.

Note that, in FIG. 7A, the light L1 and the light L2 may be lights having the same wavelength and/or intensity, or may be lights having different wavelengths and/or intensity.

It is preferred that the intensities of the two lights L1 and L2 are set different according to the melting points of the metals respectively constituting the precursors 1A and 1B.

Here, for example, it is assumed that the metal constituting the precursor 1A arranged on the left side has a lower melting point than the metal constituting the precursor 1B arranged on the right side.

In such a case, it is preferred that the intensity of the light L2 applied to the precursor 1B arranged on the right is set stronger than the light L1 applied to the precursor 1A arranged on the left.

It is further preferred that the intensities of the lights L1 and L2 are selected in accordance with the melting points of the metals constituting the precursors 1A and 1B. Thus, the time required for foaming each of the precursors 1A and 1B becomes the same level, so that the precursors 1A and 1B can be uniformly foamed.

On the other hand, if the two lights L1 and L2 have the same wavelength and intensity, the precursor 1A on the left side with a low melting point will start foaming first, and the precursor 1B on the right side with a high melting point will start foaming later.

According to the present embodiment, it is possible to produce a metal foam joined body (functionally graded material) whose properties spatially vary. Examples of the properties which spatially vary include mechanical characteristics (particularly, crash energy absorption characteristics), noise absorption characteristics, and the like.

(Modification 1)

With respect to the seventh embodiment, the metal mesh 4 can be replaced with a transparent material formed so as to surround the top and sides of the precursors 1A and 1B.

In such a case, the metal foam joined body in which the metal foams 3A and 3B are joined to each other is formed by irradiating the precursors 1A and 1B with a light transmitted through the transparent material.

(Modification 2)

In the seventh embodiment, two precursors 1A and 1B made using different metals are arranged so as to be in contact with each other.

Alternatively, the two precursors 1A and 1B may be arranged slightly apart so that the foamed metals 3A and 3B are joined to each other after their foaming.

Eighth Embodiment

Figure 8A:
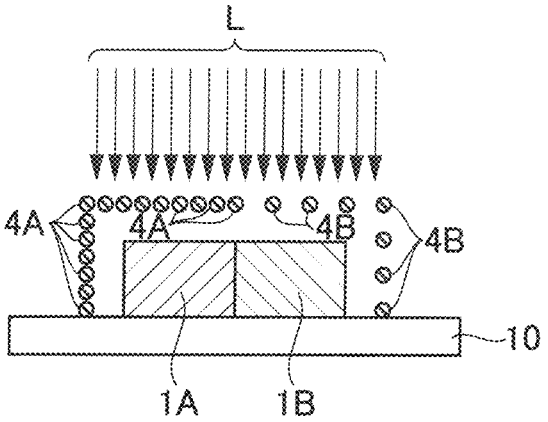
FIGS. 8A and 8B are schematic cross-sectional views showing an eighth embodiment of the present invention.
Figure 8B:
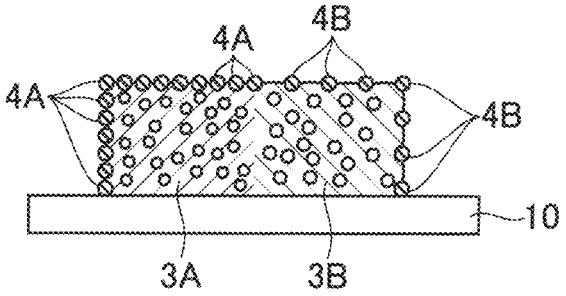

An eighth embodiment of the present invention is shown in schematic cross-sectional views of FIGS. 8A and 8B.

In the present embodiment, two metal foams obtained from different metal are joined to form a metal foam joined body by a method different from the seventh embodiment.

As shown in FIG. 8A, two precursors 1A and 1B made using different metals are arranged on the base 10 so that the two precursors 1A and 1B are in contact with each other. Further, a metal mesh 4A is provided so as to surround top and side of the left precursor 1A, and a metal mesh 4B is provided so as to surround the top and side of the right precursor 1B. The metal mesh 4A and the metal mesh 4B are joined to form an integrated metal mesh which constitutes a mold that controls the shape of the metal foam.

Here, it is assumed that the metal constituting the precursor 1A arranged on the left side has a lower melting point than the metal constituting the precursor 1B arranged on the right side. Further, it is assumed that the metal mesh 4A on the left has a small aperture ratio and the metal mesh 4B on the right has a large aperture ratio. In other words, the aperture ratios of the metal meshes 4A and 4B corresponding to the precursors 1A and 1B are selected so that the metal mesh 4A corresponding to the precursor 1A constituted by the metal with lower melting point has smaller aperture ratio.

Further, the precursors 1A and 1B is heated and foamed by being irradiated with a light L passing through the opening portions of the metal meshes 4A and 4B from above.

With such an arrangement, as shown in FIG. 8B, the precursors 1A and 1B are foamed to form two metal foams 3A and 3B each constituted by different metals, and the two metal foams 3A and 3B are joined to each other. Further, the shapes of the metal foams 3A and 3B are respectively controlled by the metal meshes 4A and 4B.

In this manner, it is possible to form a metal foam joined body in which the metal foams 3A and 3B constituted by different metals are joined to each other.

In the present embodiment, it is preferred that the aperture ratio of each of the metal meshes 4A and 4B is selected to be a specific value in accordance with the melting points of the metals constituting the precursors 1A and 1B. Thus, the time required for foaming each of the precursors 1A and 1B becomes the same level, so that the precursors 1A and 1B can be uniformly foamed.

Here, a plurality of metal meshes each having different aperture ratios were prepared, the precursors were respectively irradiated with a plurality of lights of the same intensity passing through the openings of the respective metal meshes, and the temperature-rising speeds of the precursors were measured. Further, as a comparison object, the temperature-rising speeds of the precursors were also measured in the case where the precursor was directly irradiated with the plurality of lights of the same intensity without using metal mesh.

Figure 9:
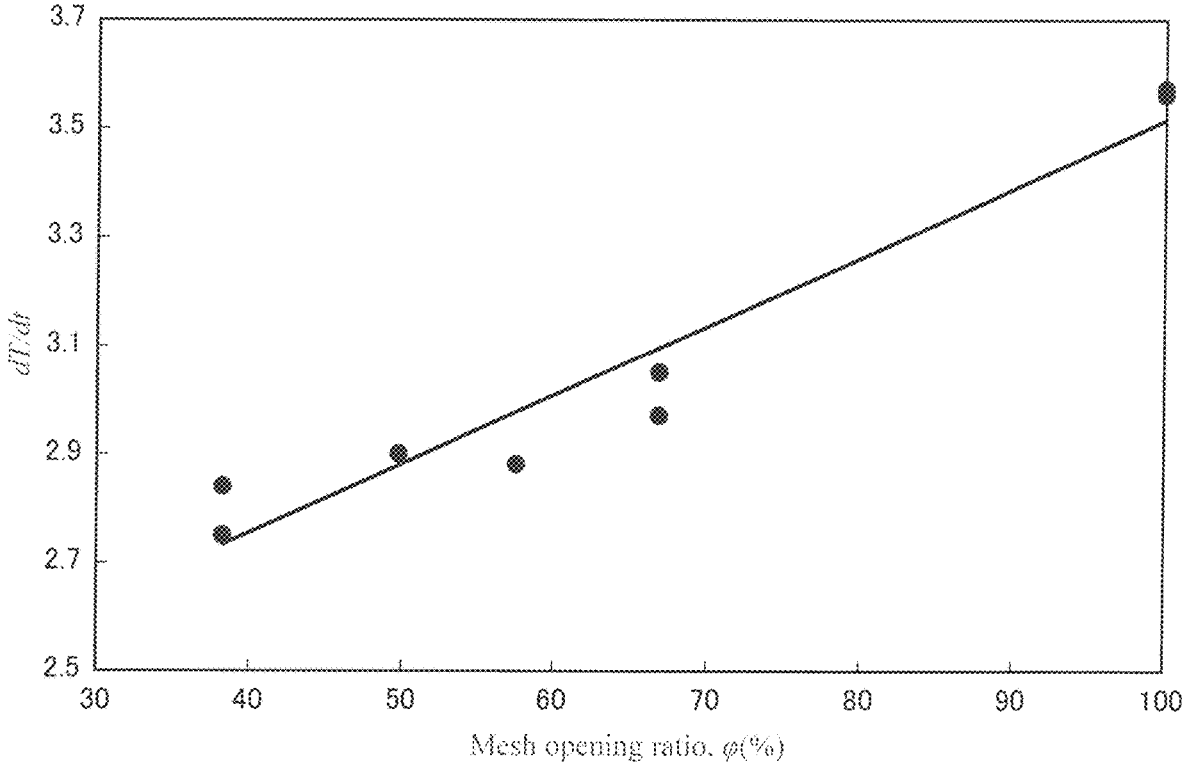
FIG. 9 is a graph showing the relationship between aperture ratio of a metal mesh and temperature-rising speed.

As a measurement result, FIG. 9 shows a relationship between the aperture ratio of the metal mesh and the temperature-rising speed (dT/dt).

As can be known from FIG. 9, the lower the aperture ratio, the slower the temperature-rising speed; and there is a linear relationship between the aperture ratio and the temperature-rising speed. Therefore, the time required for foaming can be controlled by selecting the aperture ratio of the metal mesh.

According to the present embodiment, it is possible to produce a metal foam joined body (functionally graded material) whose properties spatially vary. Examples of the properties which spatially vary include mechanical characteristics (particularly, crash energy absorption characteristics), noise absorption characteristics, and the like.

(Modification 1)

With respect to the eighth embodiment, the two metal meshes 4A and 4B may be replaced with two transparent materials formed to respectively surround the top and side of precursors 1A and 1B.

In such a case, the mold is configured so that the transmittances of the two transparent materials are different from each other; to be specific, the transmittance of the transparent material on the left precursor 1A having a low melting point is smaller than the transmittance of the transparent material on the right precursor 1B having a high melting point.

Further, the metal foam joined body in which the metal foams 3A and 3B are joined to each other is formed by irradiating the precursors 1A and 1B with a light transmitted through the transparent material.

Further, it is also possible to replace the metal meshes 4A, 4B with a material with openings other than a metal mesh (such as a ceramic honeycomb), and the aperture ratio of each part thereof is selected.

(Modification 2)

In the eighth embodiment, two precursors 1A and 1B made using different metals are arranged so as to be in contact with each other.

Alternatively, the two precursors 1A and 1B may also be arranged slightly apart from each other so that the foamed metals 3A and 3B formed are joined to each other after their foaming.

Ninth Embodiment

Figure 10:
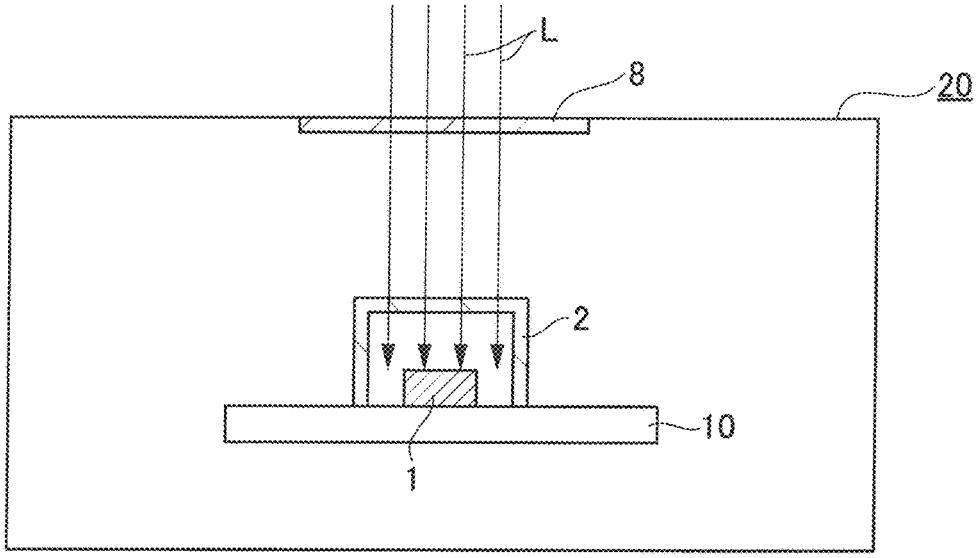
FIG. 10 is a schematic cross-sectional view showing a ninth embodiment of the present invention.

A ninth embodiment of the present invention is shown in a schematic cross-sectional view of FIG. 10.

In the present embodiment, a mold and a precursor are arranged inside a sealed container (chamber) having a transparent window. The precursor is heated and foamed into a metal foam by being irradiated with a light transmitted through the window and the mold.

As shown in FIG. 10, the upper portion of a chamber 20 (which is a sealed container) is provided with a transparent window 8. A mold made of a transparent material 2 and a precursor 1 are arranged inside the chamber 20. The precursor 1 and the transparent material 2 each have the same configurations as those shown in FIG. 1A.

The transparent materials listed as the material for the mold, such as glass, sapphire, quartz glass, crystal or the like, can be used as the material of the transparent window 8.

Since the window 8 does not come into contact with the foamed metal, the transparent material for the window 8 is not required to have heat resistance as compared with the transparent material for the mold. Therefore, a wider range of transparent materials than those for the mold can be used as the transparent material for the window 8.

Although not shown in the drawings, a light source for irradiating the precursor 1 with light is arranged outside the chamber 20.

Further, although not shown in the drawings, a vacuum pump, a gas supply unit (gas cylinder), and/or the like are/is connected to the chamber 20; therefore, the inside of the chamber 20 can be evacuated to vacuum or set to a gas atmosphere.

For example, when the inside of the chamber 20 is evacuated to vacuum or set to an inert gas atmosphere, the foam metal can be prevented from being oxidized.

Further, as shown in FIG. 10, the precursor 1 is heated and foamed by being irradiated with a light L passing through the transparent window 8 and transmitted through the transparent material 2 from above the chamber 20.

With such an arrangement, the precursor 1 is foamed into a metal foam.

In this manner, it is possible to produce a metal foam.

In the present embodiment, since the precursor 1 is foamed into a metal foam within the chamber 20, the inside of the chamber 20 can be evacuated to vacuum or set a predetermined atmosphere. Further, as described above, when the inside of the chamber 20 is evacuated to vacuum or set to an inert gas atmosphere, the foam metal can be prevented from being oxidized.

Further, since the chamber 20 is provided with the transparent window 8, it is possible to irradiate the precursor 1 with the light L from the light source arranged outside the chamber 20 through the transparent window 8.

Further, since the light source is arranged outside the chamber 20, the light source is not affected by the atmosphere inside the chamber 20. Thus, the configuration for heating the precursor 1 can be simplified, compared with a case where a light source is arranged inside the chamber 20 and a case where a heating source is arranged inside the chamber 20.

(Modification)

In comparison with the ninth embodiment, the transparent material 2 may be replaced with a metal mesh.

In such a case, similarly to the second embodiment, the metal foam shaped by the metal mesh is formed by irradiating the precursor 1 with a light passing through the opening portions of the metal mesh.

Further, with respect to the ninth embodiment, the transparent material 2 surrounding the precursor 1 may be replaced with a plate-like transparent material or a plate-like metal mesh.

Tenth Embodiment

Figure 11A:
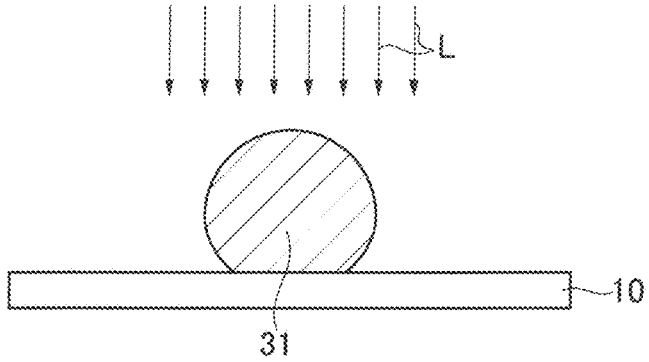
FIGS. 11A and 11B are schematic cross-sectional views showing a tenth embodiment of the present invention.
Figure 11B:
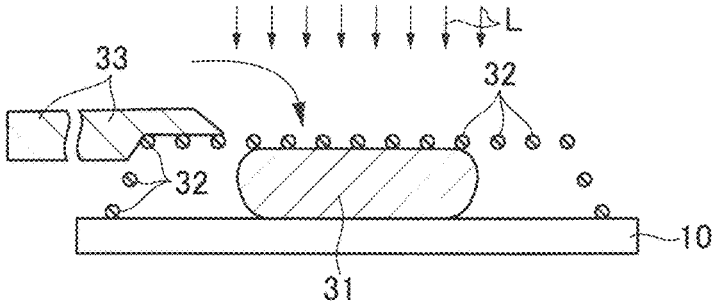

A tenth embodiment of the present invention is shown in schematic cross-sectional views of FIGS. 11A and 11B.

In the present embodiment, initially the precursor is heated and caused to foam by being directly irradiated with a light without using a mold, and then, during foaming, the precursor is pressed with a metal mesh so as to be shaped.

One precursor is irradiated with a light L so as to be foamed to form a metal-being-foamed 31 (including metal in soft state immediately after foaming), as shown in FIG. 11A.

Next, as shown in FIG. 11B, the metal-being-foamed 31 is pressed from above using a metal mesh 32 supported by a support 33. Thus, the metal-being-foamed 31 is pressed by the metal mesh 32 into a shape so that the height of metal-being-foamed 31 corresponds to the height of the upper surface of the metal mesh 32.

Thereafter, the metal-being-foamed 31 is irradiated with the light L passing through the opening portions of the metal mesh 32 so as to continue to foam. In this manner, it is possible to produce a metal foam whose shape is controlled to match the inner shape of the metal mesh 32.

According to the present embodiment, the precursor is pressed by the metal mesh 32. Therefore, if the height of the metal mesh 32 is set to be lower than the height of the precursor before foaming, it is possible to produce a metal foam having a height lower than the height of the precursor before foaming.

Further, since the press working is performed during foaming, the press working can be performed with lower load.

Further, since the precursor is pressed by the metal mesh 32, it is possible to produce a metal foam having a complicated shape if the metal mesh 32 is formed to a complicated shape.

(Modification 1)

In the aforesaid tenth embodiment, the metal foam is foamed from one precursor; however, it is also possible to foam a plurality of precursors arranged apart from each other, and perform press working during foaming to give them a shape, so that a plurality of metal foams respectively foamed from the plurality of precursors are joined to each other.

Figure 12A:
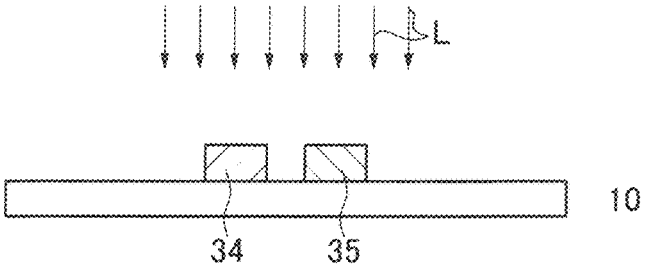
FIGS. 12A to 12C are schematic cross-sectional views showing a modification 1 of the tenth embodiment of the present invention.
Figure 12B:
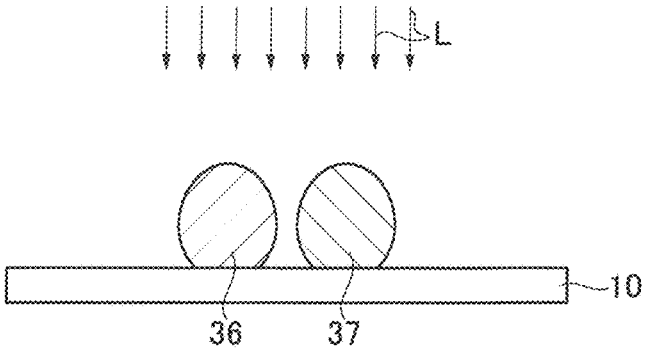
Figure 12C:
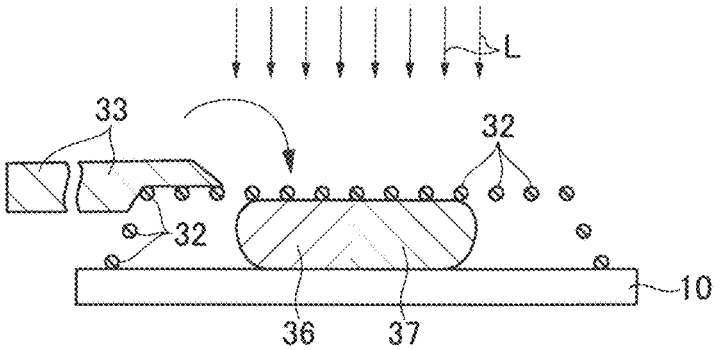

Such case is shown in the schematic cross-sectional views of FIGS. 12A to 12C as a modification 1 of the tenth embodiment of the present invention.

First, as shown in FIG. 12A, two precursors 34, 35 are arranged apart from each other, and the two precursors 34, 35 are irradiated with a light L.

Then, as shown in FIG. 12B, the precursors 34, 35 are respectively foamed to form two metals-being-foamed (including metal in soft state immediately after foaming) 36, 37.

Next, as shown in FIG. 12C, the metals-being-foamed 36, 37 are pressed from above using a metal mesh 32 supported by a support 33. Thus, the metals-being-foamed 36, 37 are pressed by the metal mesh 32 into a shape so that the height of metals-being-foamed 36, 37 corresponds to the height of the upper surface of the metal mesh 32, and the metals-being-foamed 36, 37 are joined to each other.

Thereafter, the metals-being-foamed 36, 37 are irradiated with the light L passing through the opening portions of the metal mesh 32 so as to continue to foam. In this manner, it is possible to produce a metal foam whose shape is controlled to match the inner shape of the metal mesh 32.

(Modification 2)

In the tenth embodiment and the modification 1 thereof, the metals-being-foamed 31, 36, 37 are pressed by the metal mesh 32.

In comparison with the tenth embodiment and the modification 1 thereof, the metal-being-foamed may also be pressed by a transparent material, instead of the metal mesh 32, and then the metal-being-foamed is irradiated with a light transmitted through the transparent material, to thereby form a metal foam.

[Example]

Actually, a metal foam was produced by irradiating light using a mold.

(Preparation of Precursor)

Figure 13A:
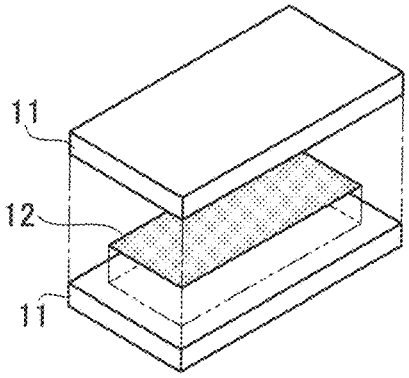
FIGS. 13A to 13E are views for explaining each step of a method for producing the precursor according to an example.

First, as shown in FIG. 13A, a foaming agent and thickening agent 12 were sandwiched between two plates 11 made of ADC12 (Al—Si—Cu-based aluminum alloy). Titanium hydride ($TiH_2$) was used as the foaming agent, and alumina was used as the thickening agent.

Figure 13B:
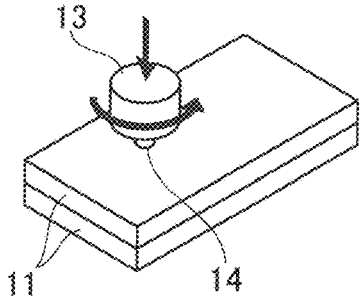

Next, as shown in FIG. 13B, a friction-stirring tool 13 having a probe 14 provided at its tip was used. The friction-stirring tool 13 was rotated at a high speed, pushed into the plates 11, and scanned on the plates 11. The rotation speed was 1000 rpm, and the scanning speed was 100 mm/min.

Figure 13C:
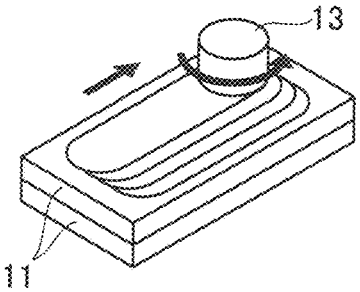
Figure 13D:
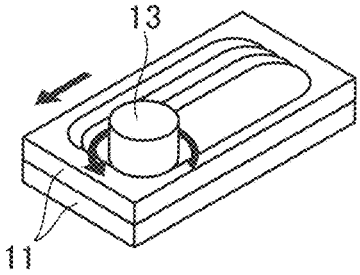

The friction-stirring tool 13 was scanned four times in the row direction as shown in FIG. 13C, and then scanned four times in the row direction at the same location from the opposite side as shown in FIG. 13D; further, such reciprocating movement of the friction-stirring tool 13 was performed once more.

In such manner, the foaming agent and thickening agent 12 were mixed and dispersed in the plates 11.

Figure 13E:
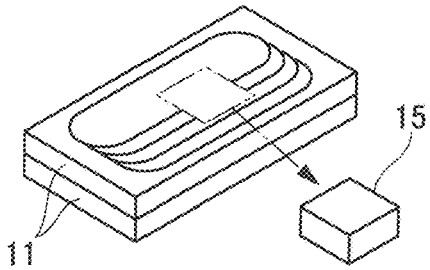

Thereafter, as shown in FIG. 13E, the plate 11 was cut into a size of 15 mm×15 mm×6 mm to obtain a precursor 15.

The precursor 15 thus prepared was used to produce a metal foam.

(Production of Metal Foam)

A plate-like mold made of sapphire was used. Instead of placing the mold directly on the precursor as shown in FIG. 3A, the mold was placed above the precursor 15 using a platform, so that, when the precursor was foamed, the metal foam would be brought into contact with the mold.

Further, the precursor 15 is heated and foamed by being irradiated with a light transmitted through the mold, so that the precursor 15 is foamed into a metal foam.

Light irradiation is performed using four halogen lamps, and the total output of the four halogen lamps is 2 kW.

Figure 14:
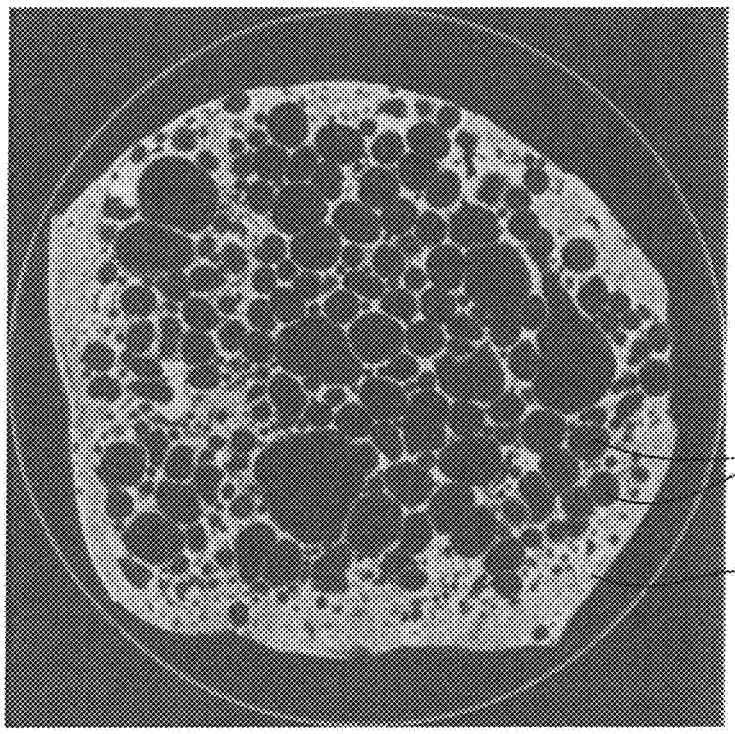
FIG. 14 is an X-ray CT image of a metal foam produced using a mold made of sapphire.

The produced metal foam was observed by X-ray CT. An X-ray CT image of the produced metal foam is shown in FIG. 14. As shown in FIG. 14, a metal foam 22 having pores 21 therein is formed.

(In a Case where a Metal Mesh was Used as Mold)

A metal foam is produced by performing light irradiation under the same condition except that a metal mesh made of steel is used as the mold. Three metal meshes were used. The thickness of the metal wire of the three metal meshes was about 0.5 mm, and the interval between metal wires of the three metal meshes were 0.67 mm, 1 mm, and 2 mm respectively.

Figure 15:
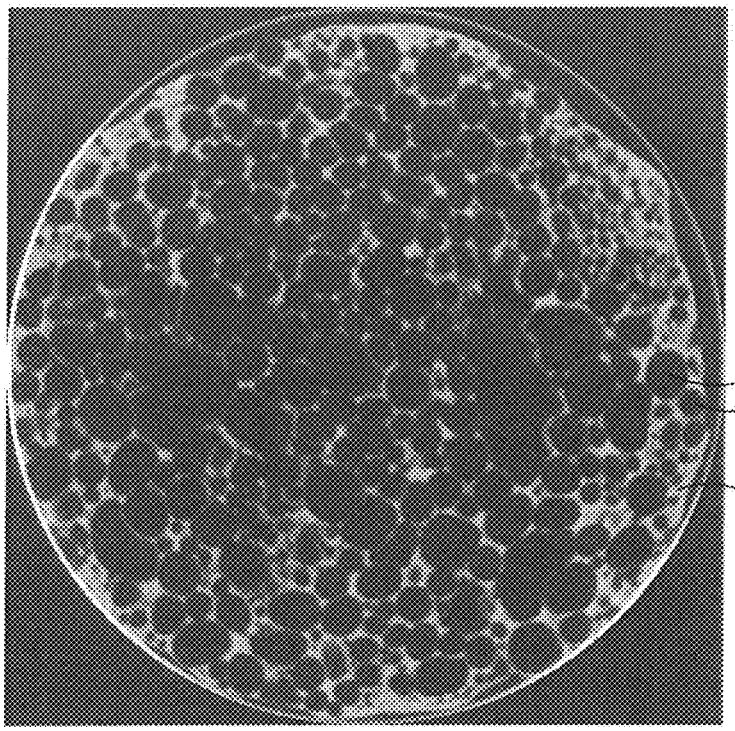
FIG. 15 is an X-ray CT image of a metal foam produced using a metal mesh as a mold.

The metal foam produced using the metal mesh as the mold was observed by X-ray CT. An X-ray CT image of the produced metal foam is shown in FIG. 15. As shown in FIG. 15, a metal foam 22 having pores 21 therein is formed.

In the cases where the interval between metal wires was 0.67 mm and 1 mm, the surface of the metal foam was substantially flat. In the case where the interval between metal wires was 2 mm, the portions of the metal foam corresponding to the openings of the metal mesh swelled slightly outward, and slight unevenness was observed on the surface of the metal foam.

(Effects of Presence or Absence of Mold on Temperature Behavior)

The difference in temperature behavior between the following two cases was examined: one is a case where the precursor 15 was irradiated with a light transmitted through a plate-like mold made of sapphire, and the other is a case where the precursor 15 was directly irradiated with a light without using a mold.

In each of above two cases, the precursor 15 is heated by being irradiated with a light in a state where the precursor 15 is in contact with a thermocouple; the light irradiation was stopped when the measurement temperature reached about 650° C., and then the precursor 15 was naturally cooled.

Figure 16:
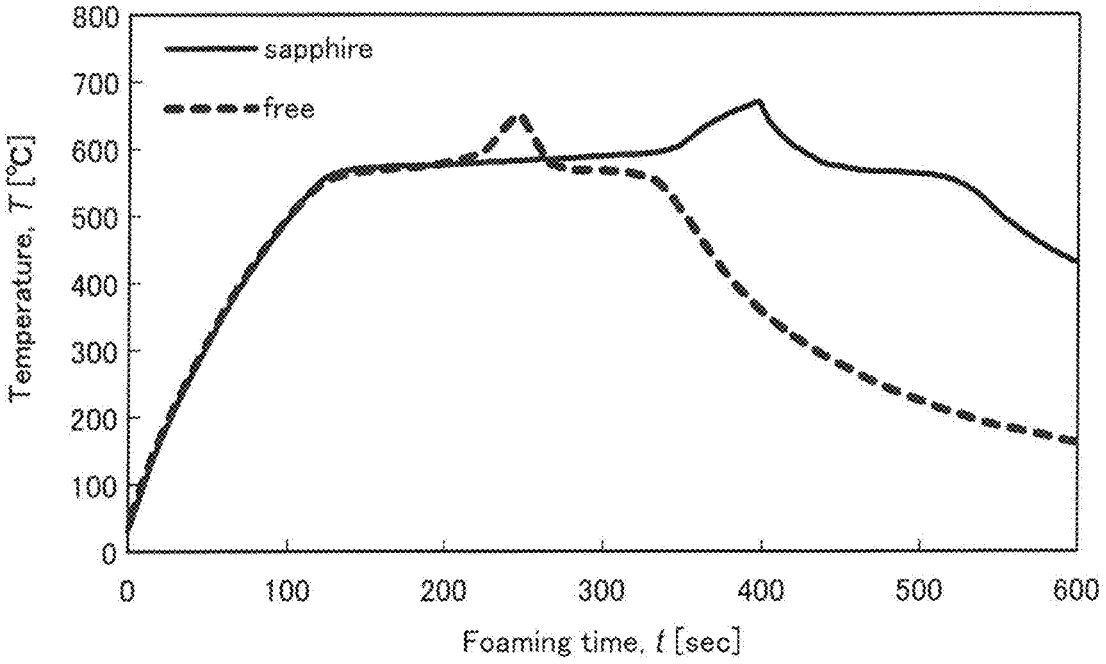
FIG. 16 is a graph comparing the relationship between the elapsed time (foaming time) and the temperature by the presence or absence of a mold.

The relationship between elapsed time (foaming time) and temperature is compared between the above two cases, and the results are shown in FIG. 16, in which the case where mold is used is indicated by a solid line, and the case where mold is not used is indicated by a broken line.

It is known from FIG. 16 that, between 0 to 200 seconds, the temperature behavior is the same regardless of whether or not the mold is used; and therefore, even if the mold made of sapphire is arranged between the light source and the precursor, there is almost no energy loss. The reason why the temperature behavior changes after 200 seconds have passed is that the foamed precursor comes into contact with sapphire, and thereby the heat of the precursor is taken away by sapphire, so that more heat energy is required. Thus, it is considered that, between 0 and 200 seconds, the sapphire is hardly warmed by light irradiation, and almost all of the light energy was given to the precursor.

Thus, when a mold made of sapphire that transmits light is used, loss of thermal energy caused by the mold can be suppressed, and therefore energy is saved.

REFERENCE SIGNS LIST 1, 1A, 1B Precursor,
2 Transparent material
3, 3A, 3B Metal foam
4, 4A, 4B, 32 Metal mesh
5 Dense metal material
6 Mask
7 Other metal foam
8 Window
10 Base
11 Plate
12 Foaming agent and thickening agent
13 Friction-stirring tool
14 Probe
15 Precursor
20 Chamber
21 Pores
22 Metal foam
31, 36, 37 Metal-being-foamed
33 Support
L, L1, L2 Light

The invention claimed is:

1. A metal foam production method comprising steps of:
using a mold that transmits light and a precursor made by mixing a metal with a foaming agent, the mold consisting of a net made of metal, the net being formed of a plurality of holes; and
irradiating the precursor with a light transmitted through the holes of the net in the mold to thereby heat and foam the precursor to obtain a metal foam, and controlling a shape of the metal foam by the mold.

2. The metal foam production method according to claim 1, wherein the mold is shaped to surround the precursor, and the metal foam is shaped by the mold.

3. The metal foam production method according to claim 1, wherein a plurality of dense metal materials are arranged around the precursor, and the precursor is foamed into the metal foam, so that the plurality of dense metal materials are joined by the metal foam.

4. The metal foam production method according to claim 1, wherein a plurality of additional metal foams are arranged around the precursor, and the precursor is foamed into the metal foam, so that the plurality of additional metal foams are joined by the metal foam.

5. The metal foam production method according to claim 1, wherein the precursor and a dense metal material are used, and the precursor is foamed into the metal foam, so that the dense metal material is joined to the metal foam.

6. The metal foam production method according to claim 1, wherein the precursor, a dense metal material and an additional metal foam are used, and the precursor is foamed into the metal foam, so that the dense metal material is joined to the additional metal foam by the metal foam.

7. The metal foam production method according to claim 1, wherein an irradiation range of light is selected by setting focus of a light source.

8. The metal foam production method according to claim 1, wherein an irradiation range of light is selected by providing a mask having an opening and shielding the light.

9. The metal foam production method according to claim 1, wherein the mold is a cylindrical mold.

10. The metal foam production method according to claim 1, wherein a plurality of the precursors each made of a different metal having a different melting point, two of the plurality of the precursors are arranged so that respective metal foams of the two precursors are joined to each other after foaming, and each precursor is irradiated with a light so as to be heated to thereby produce a functionally graded material whose properties spatially vary.

11. The metal foam production method according to claim 1, wherein the precursor includes a plurality of metals each having different melting points, a foaming agent is mixed with the plurality of metals in the precursor that is irradiated with a light so as to be heated, so that a functionally graded material whose properties spatially vary is produced.

12. A metal foam production method comprising steps of:

using a mold that transmits light and a plurality of precursors made by mixing a plurality of metals with a foaming agent, the mold being made of a material with openings, and an aperture ratio of each part of the mold corresponding to each precursor of the plurality of precursors is selected so that the part corresponding to a precursor made from a metal having a lower melting point has a smaller aperture ratio; and irradiating the plurality of precursors with a light transmitted through the mold to thereby heat and foam the plurality of precursors to obtain a metal foam, and controlling a shape of the metal foam by the mold, wherein:

the plurality of precursors are each made of a different metal having a different melting point, two of the plurality of the precursors are arranged so that respective metal foams of the two precursors are joined to each other after foaming, and each precursor, when being irradiated and heated with the light, produces a functionally graded material whose properties spatially vary, or the foaming agent is mixed with the plurality of metals in a first precursor of the plurality of precursors when the first precursor is irradiated with the light so as to be heated, so that a functionally graded material whose properties spatially vary is produced.

13. A metal foam production method comprising steps of:

using a mold that transmits light and a precursor made by mixing a metal with a foaming agent; and irradiating the precursor with a light transmitted through the mold to thereby heat and foam the precursor to obtain a metal foam, and controlling a shape of the metal foam by the mold, wherein:

the foaming agent is mixed with a plurality of metals in the precursor that is irradiated with a light so as to be heated, so that a functionally graded material whose properties spatially vary is produced, and the mold is made of a material with openings, and an aperture ratio of each part of the mold corresponding to each metal is selected so that the part corresponding to a metal having a lower melting point has smaller aperture ratio.

* * * * *